United States Patent [19]

Garrard

[11] 4,271,097

[45] Jun. 2, 1981

[54] GAS AND LIQUID AD-MIXING SYSTEM

[76] Inventor: Bruce Garrard, 126 Montgomery Ferry Dr. NE., Atlanta, Ga. 30309

[21] Appl. No.: 77,301

[22] Filed: Sep. 20, 1979

[51] Int. Cl.[3] ..... B01F 3/04

[52] U.S. Cl. ..... 261/64 D; 99/275; 99/323.1; 222/57; 222/67; 222/129.1; 222/547; 261/121 R; 261/DIG. 7

[58] Field of Search ..... 222/56–58, 222/67, 129.1, 547; 261/62, 64 D, 70, 121 R, DIG. 7; 99/275, 323.1

[56] References Cited

U.S. PATENT DOCUMENTS

| | | | |
|---|---|---|---|
| 832,903 | 10/1906 | Harris | 261/DIG. 7 |
| 1,872,462 | 8/1932 | Johnson et al. | 261/DIG. 7 |
| 2,249,794 | 7/1941 | Sutton | 261/DIG. 7 |
| 2,748,076 | 5/1956 | Bohannon | 222/57 X |
| 2,809,597 | 10/1957 | Fowler | 261/DIG. 7 |
| 3,052,377 | 9/1962 | Bill | 261/DIG. 7 |
| 3,394,847 | 7/1968 | Garrard | 222/56 |
| 3,638,833 | 2/1972 | Lucas | 222/67 X |
| 3,746,323 | 7/1973 | Buffington | 261/DIG. 7 |
| 4,174,743 | 11/1979 | Beny et al. | 222/56 X |

*Primary Examiner*—Richard L. Chiesa

[57] ABSTRACT

Shown is a horizontal model of a continuous flow motorless carbonator, which carbonates water from a pressurized source as it is drawn, with a pivoted float element connected mechanically to a gas inlet valve assembly and having an extended arm to receive impact of inlet water, the net force due to impact and weight of the float less its displacement of water, being conveyed to the gas inlet valve to control the flow of inlet gas directly, and the flow of inlet water indirectly, so that the flow rate of water equals the flow rate of carbonated water out and a constant liquid level is maintained during a draw. A vertical model with dual water inlets and a float member resting directly on a gas inlet valve and in position to receive water impact from one of the dual inlets is also shown, employing the same basic principles.

13 Claims, 3 Drawing Figures

GAS AND LIQUID AD-MIXING SYSTEM

SUMMARY AND BACKGROUND

This application for patent concerns a gas and liquid admixing system commonly known as a motorless carbonator and is an outgrowth and further development of my previous disclosure in U.S. Pat. No. 3,394,847, also a motorless carbonator. It particularly involves the carbonator tank only, and not the automatic pumping system also included in that disclosure.

The carbonator tank alone was found in recent years to have commercial application in portable outlets such as pushcarts and catering trucks for serving one dispensing valve at a time on a continuous flow basis as long as the dispensing valve is open. Water is supplied from a 5 or 10 gallon commercially available tank which is pressurized with carbon dioxide gas at 90 to 100 psi, the maximum recommended for such tanks, with the same pressure of gas also supplied to the gas inlet of the carbonator. A cold plate with ice is used usually to precool water coming to the carbonator and to post-cool the carbonated water going to the dispensing valve. A flow regulator in the outlet line maintains a constant flow rate out and induces a constant flow rate into the carbonator, with the overall design providing very cold, well carbonated water at one flow rate. The supply tank of water is pressurized continuously until vented for refilling, unlike the pump tank in the original disclosure which was vented and refilled automatically with water after each drink was drawn.

Basically, the design of the carbonator tank and its components remained the same for the commercial application as shown in the original disclosure, with the float element controlling the flow of gas into the carbonator, by means of its net weight, equal to its total weight less the weight of water it displaced, resting on a gas inlet valve, restricting gas in proportion to the weight on the valve, allowing more gas in as the water level rose and restricting it more as the water level fell. Indirectly, this action also controlled the static pressure in the carbonator, as well as the flow rate of water into the tank and the level of water in the carbonator tank. Also, impact of all the inlet water on the bottom surface of the mixing well in the float was retained, the impact force being a component of the total force delivered to the gas inlet valve arrangement.

In such an application the original design of carbonator tank worked well in providing one flow rate only, with the exception that a larger float was found to be necessary to provide the additional control needed to restrict gas entering the gas inlet valve to compensate for the greater and greater amount of gas entering with the water from the pressurized tank, due to increased absorption of gas by the water over a period of time. Unless the float weight was sufficient to provide this control too much gas and too little water would enter the carbonator for the carbonator to function properly. In the original design, using a pump tank that vented after each drink was drawn, no such problem existed, the supply water never being exposed to gas for any extended period.

The new design involves, in part, a controlled relationship between the forces of impact of inlet water on the float element and of float weight, less displacement, that are transmitted to the gas inlet valve, so that each force provides the amount and type of control that is most advantageous, whether in a design for one flow rate only, two flow rates, a vertical configuration or a horizontal one. In effect, the original design has been found to make use of too much impact force on the float for optimum design and broadest application. This excessive use of impact force requires a larger diameter gas inlet orifice to produce the proper degree of control and thereby reduces the effect of a given size float and requires a larger float and tank than would otherwise be necessary.

Several alternate ways will be shown to produce the exact amount of impact force that is advantageous and to transmit it to the gas inlet valve. Also, it will be shown how the use of a smaller gas inlet orifice to work with the reduced impact force, to produce the most desirable amount of pressure differential, enhances the effectiveness of float weight. A pivoted float arrangement that enhances float weight directly will also be shown, as well as how these principles apply to the vertical and horizontal models to widen the application of the basic idea.

Reference to the detailed description that follows will further clarify the nature of the invention and its many advantages and applications.

DESCRIPTION OF THE PREFERRED EMBODIMENT

Figure 1:
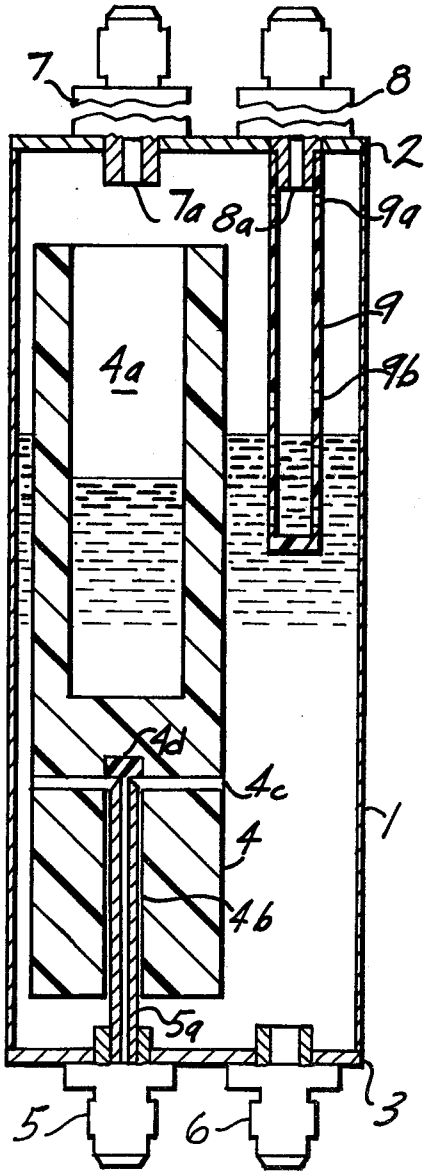
FIG. 1 is a sectional view of a vertically mounted model of the invention.

Referring again to FIG. 1, the vertical tank 1 is composed of a length of tubing welded to headers 2 and 3 at the top and bottom respectively. Water inlet fittings are shown, with numerals 7 and 8, mounted in top header 2, and normally take the form of check valves, with outlet orifices 7*a* and 8*a*. A float element 4, preferably of polyethylene or similar material with a specific gravity slightly less than 1, has a mixing chamber 4*a* for receiving inlet water from orifice 7*a* and mixing it with gas. A gas inlet tube 5*a* is an integral part of gas inlet fitting 5 and is accommodated in hole 4*b* in a free fit. A seat 4*d* is installed at the upper end of hole 4*b* and is made of rubber or other suitable resilient material, to provide an effective closure in contact with the upper tapered end of tube 5*a*. Side holes 4*c* direct the gas leaving the end of tube 5*a* outward into the general tank area. Seat 4*d* and tube 5*a* combine to form what will be referred to as a gas inlet valve.

An aerating type device is shown attached to the inner end of water inlet fitting 8, comprising a plastic tube 9 with an open upper end for press fit onto the orifice end of fitting 8. The bottom end is closed and side holes 9*a* allow gas into the tube bore to mix with the water entering from orifice 8*a*. The mixture leaves through side holes 9*b* nearer the bottom of tube 9.

The water level is shown at more or less normal operating level, which varies somewhat with operating conditions. The water level in chamber 4*a* is the residue from the bubbly mixture of gas and water that fills the chamber during a draw of a drink. Outlet fitting 6 in bottom header 3 is for connection to a dispensing valve or valves, through a cold plate or other cooling means, if desired. Water inlet fittings 7 and 8 provide ideal means for connection to dual lines from the water supply tank or tanks in order to minimize the pressure drop required. The use of a separate 5 or 10 gallon tank to supply each inlet fitting is especially efficient and ideal for high volume portable outlets that need the capacity of two tanks anyway.

Recommended use involves supplying the water tank or tanks with the same gas pressure that is supplied to gas inlet fitting 5. Then when a dispensing valve is opened and soda is drawn from tank 1, the water level falls somewhat and the net weight of float 4 resting on the top of inlet tube 5*a* increases, restricting the flow of gas into tank 1. The evacuation of water produces a decrease in pressure in tank 1 as a result, which induces flow from the water supply, where the pressure is undiminished, into the reduced pressure of carbonator tank 1. The portion of water entering through orifice 7*a* causes an impact force on the bottom of chamber 4*a*, which is proportional to the product of flow rate and velocity, or to the square of flow rate, in this case. This force is transmitted directly to the top of tube 5*a* through seat 4*d* and contributes to the control of gas entering through tube 5*a*. As a draw continues at a given flow rate the water level reaches an equilibrium level where the total force of impact and net float weight produces a pressure differential, equal to total force divided by orifice area, between the supply tanks and carbonator tank that is exactly right to induce the flow rate of water in to equal the draw rate. When the dispensing valve closes, the water level immediately starts to rise and the rate of water entering immediately slows, causing less impact and less float weight on the top of tube 5*a*, both effects tending to allow a rapid inflow of gas that causes the static pressure of the carbonator to quickly equal that of the supply tanks, and causes inlet water flow to cease almost instantaneously. The same effect in reverse tends to induce rapid acceleration of inlet water when the dispensing valve is first opened, both effects contributing to efficiency by limiting to a small amount the water that enters slowly and is not broken up sufficiently for fastest absorption of gas.

One of the principal features of this design is its ability to highly carbonate water directly from the supply tank without cooling, provided the water temperature does not exceed about 80° F., and to do so at two flow rates within the limitation of 90 to 100 psi pressure in the supply tank. In order to do this it was found advantageous to use the dual inlets and lines to minimize pressure drop, or differential, from the supply tanks to the carbonator to about 7 psi for the flow rate of one dispensing valve and to about 20 psi for two valves. The dual lines and fittings and use of no cold plate circuit apparently produce a type of flow known as smooth pipe flow where the pressure differential varies with flow rate to the 1.7 power approximately. For twice the flow rate about three times as much differential is needed, compared to four times as much for turbulent flow, the usual case with single lines and cold plate.

It has been found advantageous also in this design to use a portion of inlet water to produce impact on tube 5*a* and to use as small a tube orifice as practical to supply the needed flow of gas, approximately 0.062 inches being a good choice. The water flow is divided so that the impact force on the area of the chosen orifice produces the approximate differential in pressure to induce the single flow rate into the carbonator, the water level preferably operating a little below midpoint of the float. Then when two valves are opened together the water level tends to rise near the top of the float, due to the fact that the component of force on tube 5*a* from impact increases with the square of the flow rate to four times what is was, whereas only about three times as much is needed to produce the required differential. The float must counteract some of this force to establish equilibrium, which it does by allowing the water level to rise, actually producing a negative force due to float buoyancy and a total force that produces the exact differential needed for the flow rate.

In this way there is also some float weight available to compensate when the water brings more and more dissolved gas with it from the supply tank or tanks. The water level will tend to operate lower on the float for both flow rates.

It can now be better understood that the effectiveness of the float to make these compensations is related to the orifice area of tube 5*a*, which in turn is related to the amount of impact force used, so that the use of less impact force and less orifice area tends to enhance the effectiveness of a given size float.

Figure 2:
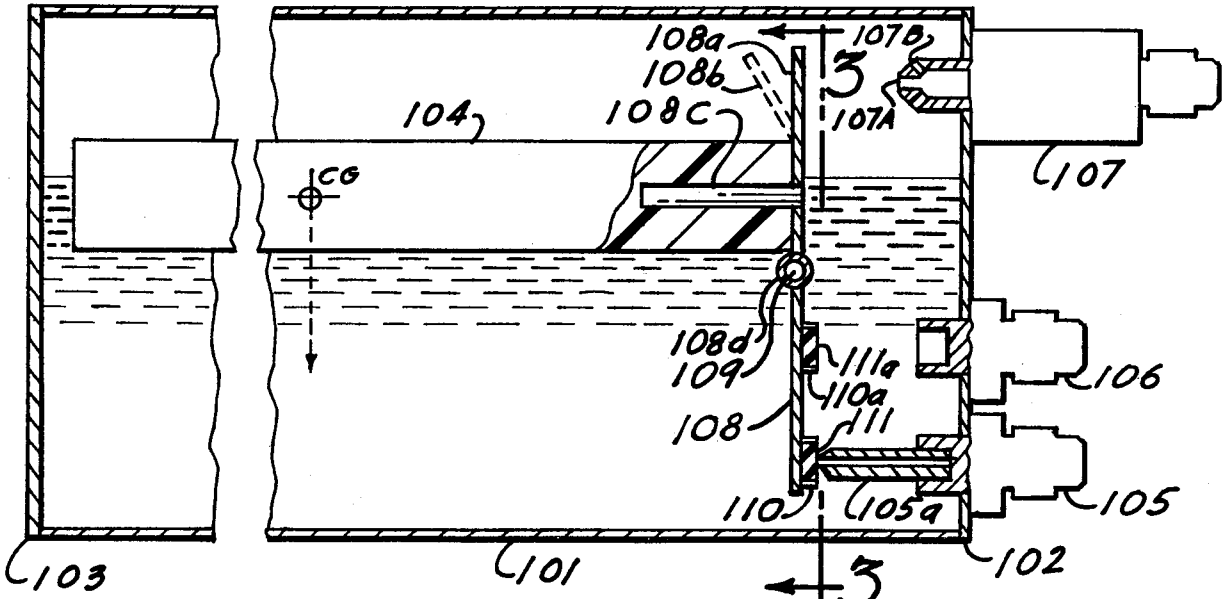
FIG. 2 is a sectional view of a horizontally mounted model of the invention.
Figure 3:
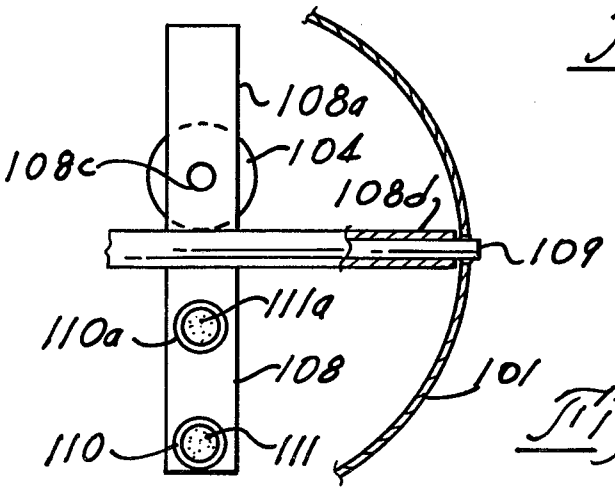
FIG. 3 is a sectional view taken along line 3—3 of FIG. 2.

Referring now to FIG. 2, showing the model for mounting horizontally, 101 refers to the tank as a whole, which comprises a length of stainless metal tubing joined to stainless metal headers 102 and 103. A float element 104, preferably made of polyethylene or similar plastic material somewhat lighter than water and impervious to carbonated water, is mounted on metal pin 108*c*, which in turn is a rigid part of the float assembly composed of it along with upper arm 108*a*, lower arm 108 and tubing 108*d*, the parts being suitably attached by appropriate means. The assembly is pivotally mounted on pin 109, which fits freely in the bore of tube 108*d* and is attached to main tube 101, as shown in FIG. 3, where the detail of one end only is shown, the other end being similar.

The water inlet fitting 107, usually a check valve, is shown mounted near the top of header 102 and delivers water to the interior of tank 101 through center orifice 107*a* and several divergent orifices 107*b*. Water from orifice 107*a* is directed toward upper arm 108*a* for impact on its surface, which is normal to the direction of flow. A dotted line representation 108*b* shows that the arm can be shaped to receive the impact at an angle other than normal if desired to reduce the resultant force. The water from orifices 107*b* is directed away from arm 108*a* and is not intended to produce impact on 108*a*. The portion of 108*a* above the float element 104 can be eliminated entirely if no impact force is needed or desired in a particular application.

Gas inlet fitting 105 is shown mounted in header 102 near its bottom. Integral with it is tube 105*a*, which has a tapered inner end contacting resilient seat 111, which is mounted in a short section of tubing 110, in turn secured to lower arm 108. Soda outlet fitting 106 is mounted just above 105 in header 102. A duplicate of parts 110 and 111 is shown mounted on arm 108 opposite fitting 106 so that fittings 105 and 106 can be interchanged to obtain greater leverage of the forces delivered to the end of gas inlet tube 105*a*, if desired.

The float element 104 and tube or tank 101 are shown in broken section to indicate greater length than shown. The center of gravity of float element 104 is indicated by a circle and the designation C/G, with an arrow downward from it indicating the force due to gravity. The lever arm of the float weight, or buoyancy, equal to float weight less the weight of water displaced, can be seen to be the horizontal distance from the center of gravity C/G to pin 109. Likewise, the impact of water on arm 108*a* has a lever arm equal to the vertical distance from pin 109 to the horizontal alignment of orifice 107*a* with arm 108*a*. The lever arm to the gas inlet tube is the distance from pin 109 vertically downward to the centerline of tube 105*a*. In the lower position of fitting 105*a* shown the lever arms to impact on 108*a* and to the gas inlet tube 105*a* are approximately equal, while the lever arm to the center of gravity of float 104 is appreciably greater, giving float weight relatively more leverage than impact as it affects the gas inlet valve arrangement at the end of tube 105*a*. If fitting 105 were moved upward to its alternate position, where 106 is, the leverage of impact and float weight would both be increased relative to the gas inlet valve, but their effects relative to each other would remain the same, float leverage still being the higher.

The water level is shown near the top of float 104, which is the approximate operating level during a draw and between draws, varying somewhat with conditions. Similarly to the vertical model, when a dispensing valve opens the water level falls, increasing the force due to float weight that is delivered to seat 111 and tube 105*a*, which restricts the flow of gas into the carbonator, inducing flow of water through water inlet 107 from a pressurized source. Water from orifice 107*a* delivers an impact force to the gas inlet valve and increases the restriction of gas, helping to accelerate the incoming water faster to equal the flow rate going out. When the dispensing valve closes, the water level rises and the flow rate of inlet water decreases, both effects reducing the restriction of inlet gas, with the almost instantaneous result that water flow into the carbonator ceases. The impact of water on arm 108*a* is efficiently broken up for virtually instantaneous carbonation of cold entering water. Water entering through orifices 107*b* is also efficiently carbonated, depending somewhat on the number and smallness of the streams of water to expose the maximum area of water to gas quickly.

Portable use of this model with a pressurized tank of water as a source will preferably employ a cold plate to pre-cool the water entering the carbonator, with two parallel circuits being used to minimize pressure drop when it is desired to dispense at two flow rates. No post cooling of the water going to the dispensing valve is required since this model is ideal for locating in a bank of ice, which preserves and contributes to refrigeration. The float is called on to make similar compensations already described for the vertical model and it will be obvious that the arrangement shown enhances the ability of a given size float to do that in several ways, such as divided flow of the inlet water for impact of a portion only on arm 108*a*, use of an angle of impact other than normal when shape 108*b* is used, and the high leverage arm of the float element 104.

In addition to its high volume application commercially in portable outlets, this model is ideal for use in a home refrigerator with water supplied at city water pressure, with little or no pre-cooling of it before entering the carbonator. Cooling and carbonation take place gradually in such an application and the horizontal mounting is easily accommodated in a large volume size that is necessary in order to store enough cold carbonated water not to be unduly affected by the entry of relatively warm, non-carbonated water each time a drink is drawn. Also, its pivoted float arrangement is ideal for providing maximum capability of a given size float to compensate for a drop in city water pressure. Gas pressure can be supplied at the maximum city water pressure expected, and the pivoted float is capable of reducing the static pressure in the tank to any practical level to induce the flow of water into the carbonator to replace that drawn from it. The minimum size float increases the storage of a given size tank and the horizontal mounting increases the area of water exposed to gas for faster absorption. The location of all fittings in one header is also advantageous in this application and can be of advantage in some low volume commercial applications where it is desirable to use city water in conjunction with a cold plate and the carbonator mounted under it in a manner that meets sanitation requirements.

I claim:

1. A continuous flow carbonator for mixing inlet carbonating gas and inlet water continously while carbonated water is being dispensed, the inlet flow rate of gas and water being equal to the outlet flow rate of water and gas mixture, said inlet water having an inherent capacity to produce an impact force of magnitude F, equal to the product of its mass flow rate and velocity, on a surface normal to its velocity, said carbonator comprising a tank, a float assembly in said tank responsive to the level of liquid in the tank and a surface on the assembly receptive to and responsive to the impact of at least a portion of said inlet water, regulator means in said tank, including an orifice and closure, for controlling the flow of said inlet gas and the static pressure in the tank responsive to a resultant force delivered to said regulator means to bias said closure against said orifice, the greater the force the greater the restriction and the less said static pressure, said force being the resultant of a weight force due to float weight less the weight of water it displaces and of an impact force due to impact of inlet water on said surface of the float assembly, and mechanical connecting means for delivering said resultant force from said float assembly to said regulator means, said impact force being diminished in its delivered amount to said regulator means to an amount less than magnitude F, and said weight force being undiminished in its delivered amount to said regulator means.

2. A carbonator as in claim 1 in which the orifice area is proportional to the delivered amount of said impact force and is therefore reduced accordingly, the capacity of the float per unit weight to produce restriction and to reduce static pressure in the tank being thereby enhanced compared to its capacity with a larger orifice when the delivered amount of impact force is not diminished.

3. A carbonator as in claim 1 in which the delivered amount of impact force is diminished by inlet water means, said means dividing the inlet water and directing a portion only thereof to impact on said float assembly surface.

4. A carbonator as in claim 1 in which said float assembly surface is at an angle other than normal to the direction of flow of inlet water, thereby diminishing the delivered amount of said impact force to said regulator means.

5. A carbonator as in claim 1 in which the float assembly is mounted on a pivot and the lever arm of the force due to float weight is greater than the lever arm of the impact force of inlet water on said float assembly surface, enhancing the effect of float weight force relative to impact force in their delivered amounts to said regulator means.

6. A carbonating system for partially carbonating inlet water continuously while highly carbonated water is being dispensed, the inlet flow rate of water being the same as the dispensing flow rate of carbonated water, additional carbonation of inlet water being absorbed gradually over a substantial period of time before it is dispensed, said system including a source of gas under pressure, a source of water under pressure, dispensing means and a combination mixing and absorption tank, said tank comprising a horizontal tube closed by a header at each end, said tank including gas inlet means located in one of the headers and connected to the source of gas, water inlet means located in one of the headers and connected to the source of water, carbonated water exit means connected to the liquid in the tank and to the dispensing means, gas inlet regulator means in said tank including a float assembly responsive to the level of liquid in the tank, said assembly including a slender elongated horizontal float member, and closure means contacting said gas inlet means, said gas inlet means including an orifice contacting said closure, said closure being biased against said orifice with a force proportional to the weight of the float member less the weight of water it displaces and a pressure differential being thereby produced, when carbonated water is being drawn from the tank, to reduce the static pressure in the tank a differential amount less than the gas supply pressure proportionally to said force and inversely proportional to the cross sectional area of said orifice, the static pressure being reduced as the water level falls on the float member, increasing said force, until the static pressure in the tank is enough below the water supply pressure to induce the inlet water flow rate to equal the flow rate of outlet liquid, the liquid level remaining essentially constant during the draw cycle and rising on the float at the end of the cycle until the tank static pressure increases to equal the water supply pressure, the float member being essentially stationary and both levels of liquid being within a narrow range, not exceeding the upper and lower limits of the slender elongated float member.

7. A carbonating system as in claim 6 in which the orifice size is approximately 1/16 inch diameter and 0.003 square inches in area and the weight of the float member required for each pound per square inch of differential produced is 0.003 pounds, a weight of 0.15 pounds, or 2.4 ounces, producing 50 psi of differential.

8. A carbonating system as in claim 7 in which the float assembly is pivoted and the force due to float weight biasing the closure is increased due to leverage by a factor of at least 2 to 1, reducing the float weight required to produce 50 psi differential to 1.2 ounces or less.

9. A carbonating system as in claim 6 in which said float member extends horizontally in the upper portion of said tank, the liquid level being maintained in the upper portion of the tank but substantially below the top of the tank, a substantial interface area of contact between gas and water being maintained and a substantial volume of liquid storage, not less than approximately half a tank, being maintained as a buffer between said partially carbonated entering inlet water and more highly carbonated heavier liquid near the bottom of the tank.

10. A carbonating system as in claim 6 in which inlet water enters the tank essentially parallel to the liquid surface in the tank and causes a minimum of agitation of the liquid already in the tank.

11. A carbonating system as in claim 6 in which the gas inlet and water inlet are in the same header.

12. A carbonating system as in claim 11 in which carbonated water exit means is in the same header as said inlet.

13. A carbonating system as in claim 6 in which the float member is of minimal volume relative to tank volume and is of minimal lateral area relative to the interface area of contact between water and gas.

* * * * *